US005087922A

United States Patent [19]

Tang et al.

[11] Patent Number: 5,087,922

[45] Date of Patent: Feb. 11, 1992

[54] MULTI-FREQUENCY BAND PHASED ARRAY ANTENNA USING COPLANAR DIPOLE ARRAY WITH MULTIPLE FEED PORTS

[75] Inventors: Raymond Tang, Fullerton; Kuan M. Lee, Brea; Ruey S. Chu, Cerritos, all of Calif.

[73] Assignee: Hughes Aircraft Company, Los Angeles, Calif.

[21] Appl. No.: 447,974

[22] Filed: Dec. 8, 1989

[51] Int. Cl.[5] ..... H01Q 21/120; H01Q 21/060; H01Q 9/280; H01Q 9/160

[52] U.S. Cl. ..... 343/814; 343/795; 343/801; 343/813; 343/816; 343/821; 343/853

[58] Field of Search ..... 343/700 MS File, 810, 343/846, 795, 801, 813, 814, 816, 820, 821, 822, 823, 824, 853, 827

[56] References Cited

U.S. PATENT DOCUMENTS

| | | | |
|---|---|---|---|
| 2,409,944 | 10/1946 | Loughren | 343/814 |
| 2,655,599 | 10/1953 | Finneburgh, Jr. | 343/801 |
| 3,680,147 | 7/1972 | Redlich | 343/801 |
| 4,097,868 | 6/1978 | Borowick | 343/795 |
| 4,912,481 | 3/1990 | Mace et al. | 343/700 MS |

FOREIGN PATENT DOCUMENTS

| | | | |
|---|---|---|---|
| 0538648 | 10/1979 | U.S.S.R. | 343/814 |

OTHER PUBLICATIONS

"Experimental Results of a Multifrequency Array Antenna", J. E. Boyns et al., IEEE Transactions on Antennas and Propagation, Jan. 1972, pp. 106-107.

*Primary Examiner*—Michael C. Wimer
*Assistant Examiner*—Peter Toby Brown
*Attorney, Agent, or Firm*—Wanda K. Denson-Low

[57] ABSTRACT

In a printed circuit embodiment, dielectric boards in a multilayer arrangement have their ends protruding from a ground plane. Sets of printed dipole elements are disposed along the edge of each board. Each set of dipole elements has three feed ports. Bandpass filters are provided for each feed port. Phase shifters are coupled to each of the feed ports through its respective bandpass filter. At the low band, the outer feed ports are shorted by the filters so that the two sections of dipole elements to the left of the center feed port form one lone band dipole arm, and the two sections of dipole elements to the right of the center feed port form the other low band dipole arm. The low band dipole is driven at the center feed port. At the high band, the center feed port becomes an open circuit so that the two sections to the left thereof form one high band dipole, and the two sections to the right thereof form a second high band dipole. The two outer feed ports drive the dipole array at the high band. In an MMIC embodiment, printed circuit stubs are bridged across the outer feed ports. The length of each stub is one wavelength at the low frequency band, and one-and-one-half wavelengths at the high frequency band. At the low frequency, the stubs appear to be short-circuited. At the high frequency band, the terminals of the stubs provide a 180 degree phase difference for a balun.

5 Claims, 4 Drawing Sheets

MULTI-FREQUENCY BAND PHASED ARRAY ANTENNA USING COPLANAR DIPOLE ARRAY WITH MULTIPLE FEED PORTS

BACKGROUND

The present invention relates to phased array antennas, and more particularly, to multi-frequency band phased array antennas employing a coplanar dipole array having multiple feed ports.

Heretofore, shipboard radars, airborne radars, and ground based radars have generally employed separate radar antennas for different radar operations. For example, a radar might employ a first antenna for surveillance, a second antenna for communications, and a third antenna for ESM applications. However, the disadvantage of separated radar antennas is that the radar is not compact. Instead, it is heavy, unwieldy and has little mobility. To overcome this disadvantage, it has been found desirable to have a multi-frequency band phased array antenna.

One prior art attempt to supply this need is described in a paper entitled "Experimental Results of a Multi-Frequency Array Antenna" by J. E. Boyns and J. H. Provencher, published in the IEEE Transactions on Antennas and Propagation, January 1972, pages 106, 107. It describes an array antenna containing three arrays of interlaced radiating elements with operating frequencies in L, S and C bands. The array elements are open-ended waveguides. However, that multi-frequency array has several disadvantages. The presence of the low frequency elements generates significant grating lobes due to the scattering of the high frequency signals from the low frequency elements. The radiating elements for different frequency bands are cross-polarized, which limits system applications. Furthermore, the high frequency incident signal is coupled into the low frequency array and the isolation is not good. This is discussed in the above-cited paper.

Accordingly, it is a feature of the present invention to provide an arrangement of radiating elements combined into arrays for multiple frequency phased arrays that span over several frequency bands. Another feature of the invention is the provision of a multi-frequency band phased array antenna that has a compact radiating aperture design with no blockage between radiating elements. Yet another feature of the present invention is to provide a multi-frequency band phased array antenna that is compact, light in weight and mobile.

SUMMARY OF THE INVENTION

In accordance with these and other features and advantages of the invention, there is provided a plurality of dipole elements interconnected with a plurality of feed ports by a plurality of band pass filters. The dipole elements all lie in the same plane. The bandpass filters present open circuits or short circuits at particular operating frequency bands. This has the result of achieving a different effective dipole length for each operating frequency band. Hence, from a single antenna aperture, there is provided a multi-frequency band phased array antenna by employing a coplanar dipole array with multiple feed ports.

In a printed circuit embodiment, dielectric boards in a multilayer arrangement have their ends protruding from a ground plane. Sets of printed dipole elements are disposed along the edge of each board. Each set of dipole elements has three feed ports. Bandpass filters are provided for each feed port. Phase shifters are coupled to each of the feed ports through its respective bandpass filter. At the low band, the outer feed ports are shorted by the filters so that the two sections of dipole elements to the left of the center feed port form one low band dipole arm, and the two sections of dipole elements to the right of the center feed port form the other low band dipole arm. The low band dipole is driven at the center feed port. At the high band, the center feed port becomes an open circuit so that the two sections to the left thereof form one high band dipole, and the two sections to the right thereof form a second high band dipole. The two outer feed ports drive the dipole array at the high band.

In an MMIC embodiment, printed circuit stubs are bridged across the outer feed ports. The length of each stub is one wavelength at the low frequency band, and one-and-one-half wavelengths at the high frequency band. At the low frequency, the stubs appear to be short-circuited. At the high frequency band, the terminals of the stubs provide a 180 degree phase difference for a balun.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
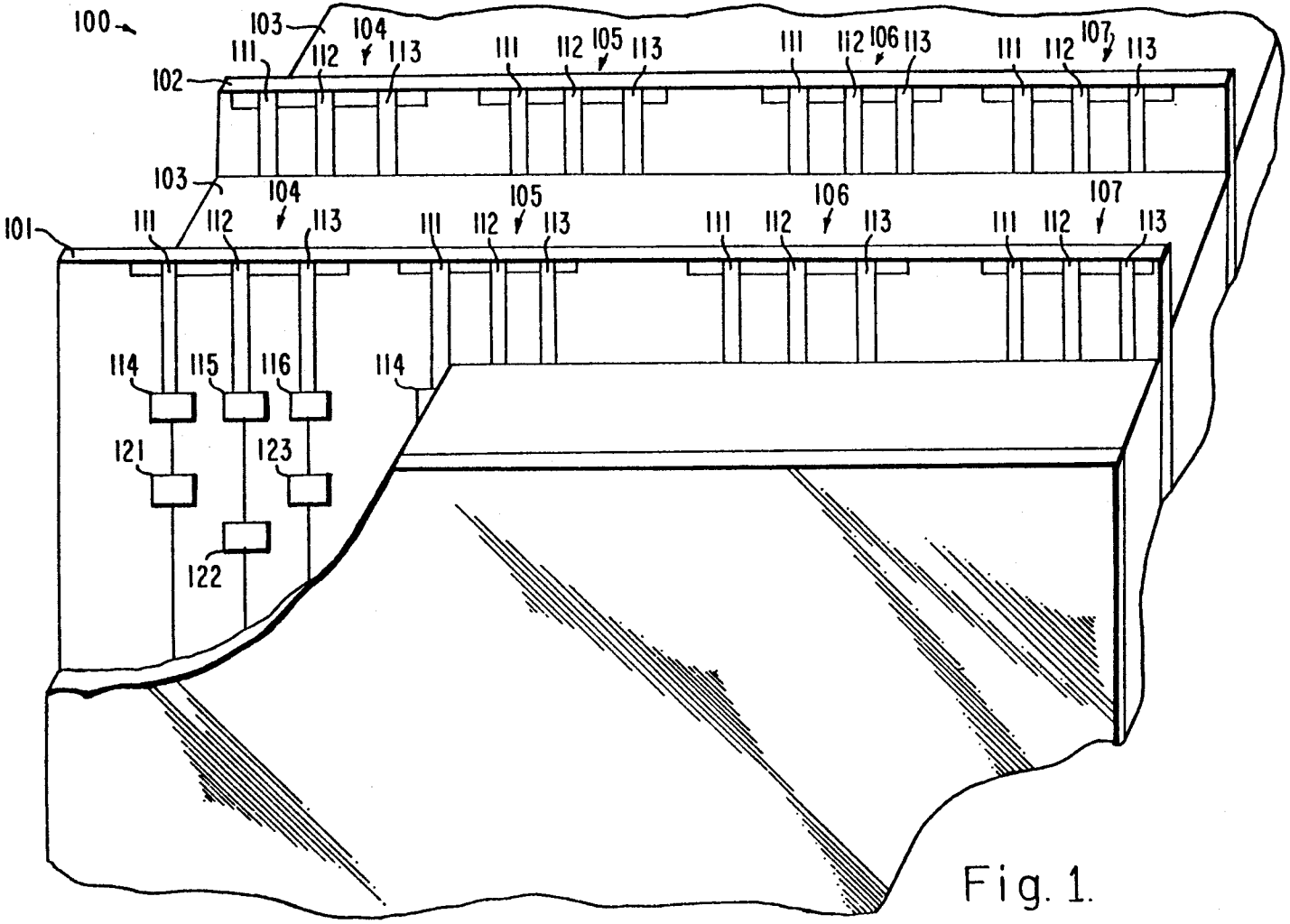
FIG. 1 is a perspective view of a two-dimensional multiple feed multilayer dipole array constructed in accordance with the principles of the present invention.

Referring now to FIG. 1 of the drawings, there is shown an embodiment of a dipole array 100 constructed in accordance with the principles of the present invention using printed circuit techniques. Two dielectric boards 101, 102 are provided in a stacked multilayer arrangement with their ends protruding from a ground plane 103. Four sets of printed circuit dipole elements 104, 105, 106, 107 are arranged in collinear fashion along the edge of each dielectric board 101, 102. Each set of dipole elements 104, 105, 106, 107 is provided with three feed ports 111, 112, 113. Three bandpass filters 114, 115, 116 are provided, one for each of the feed ports 111, 112, 113. In addition, three phase shifters 121, 122, 123 are provided, one coupled to each of the feed ports 111, 112, 113 through its respective bandpass filter 114, 115, 116.

This arrangement of the printed circuit dipole array 100 comprises a multi-frequency band phased array antenna using coplanar dipole elements 104, 105, 106, 107 with multiple feed ports 111, 112, 113. Furthermore, this arrangement of the printed circuit dipole array 100 also comprises a stacked two-dimensional multiple feed multilayer dipole array. The feed network arrangement for this stacked two-dimensional multiple feed multilayer dipole array 100 is simple and compact. The dipole elements 104, 105, 106, 107 and their associated feed networks and phase shifters 121, 122, 123 are printed on the same dielectric board 101, 102.

In operation, the bandpass filters 114, 115, 116 act as either a short circuit or an open circuit. At the low frequency band, outer feed ports 111 and 113 are shorted so that the two sections of the dipole elements 104, 105, 106, 107 to the left of the center feed port 112 form one low band dipole arm and the two sections of the dipole elements 104, 105, 106, 107 to the right of the center feed port 112 form the other low band dipole arm. Thus, the low frequency dipole is driven by the center feed port 112.

At the high frequency band, the center feed port 112 is an open circuit so that the two sections to the left thereof form one high band dipole, and the two sections to the right thereof form a second high band dipole coplanar with the first. Thus, the two outer feed ports 111, 113 drive the dipole array 100 at the high frequency band. The operation of the embodiment of FIG. 1 will be more fully understood when taken with the description of the schematic diagram illustrated in FIG. 2, along with the excitation current distribution patterns shown therein.

Figure 2:
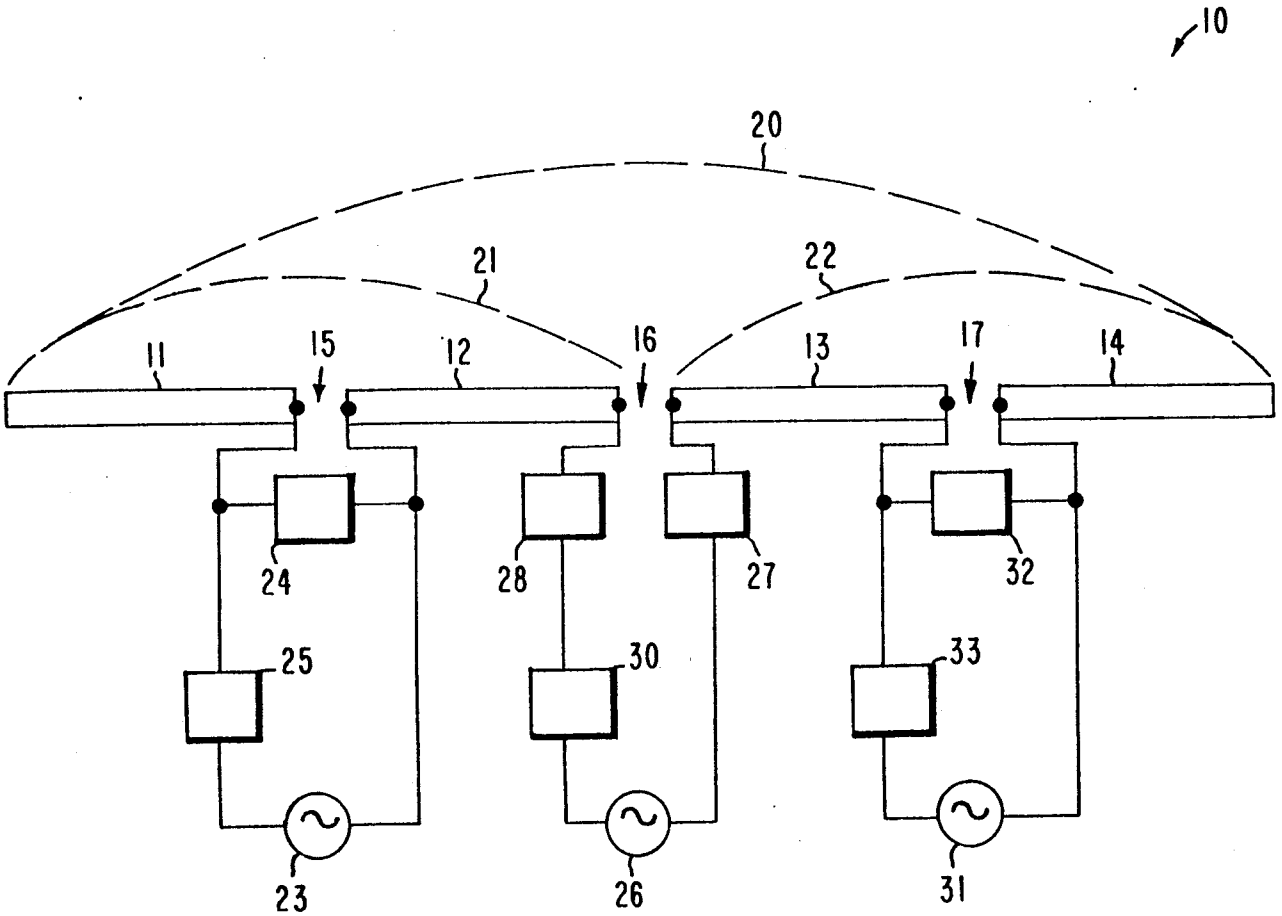
FIG. 2 is a schematic diagram of a multi-frequency band phased array antenna element in accordance with the invention illustrating dual band operation using a dipole array with multiple feed ports.

Referring now to FIG. 2 of the drawings, there is shown a schematic diagram of a dual band phased array antenna 10 illustrating the principles of the present invention. The antenna 10 is provided with four antenna elements 11, 12 13, 14 disposed in a coplanar arrangement. These four antenna elements 11, 12 13, 14 form a dipole array having three feed ports 15, 16, 17, hereinafter referred to as center feed port 16 and outer feed ports 15, 17. At the low band, the outer feed ports 15, 17 are shorted so that elements 11 and 12 form half of a low band dipole element, and elements 13 and 14 form the other half of a low band dipole element. When the low band dipole is driven at the center feed port 16, a low band dipole excitation current distribution pattern 20 results.

At the high band, the center feed port 16 is an open circuit so that elements 11 and 12 form one high band dipole, and elements 13 and 14 form a second high band dipole coplanar with the first. When the two high band dipoles are driven at the outer feed ports 15, 17, high band dipole excitation current distribution patterns 21 and 22 are produced.

The outer feed port 15 is connected to an excitation generator 23. An outer bandpass filter 24 bridges across the outer feed port 15, and the generator effective internal impedance 25 is in series between the generator 23 and element 11. The center feed port 16 is connected to an excitation generator 26 by two bandpass filters 27, 28. In this case, the first filter 27 is in series between one side of the generator 26 and the end of element 13 located at the center feed port 16. The second filter 28 is connected in series between the other side of the generator 26 and the end of element 12 located at the center feed port 16. The generator effective internal impedance 30 is shown in series between the generator 26 and the second filter 28. The other outer feed port 17 is connected to an excitation generator 31 by way of a second outer bandpass filter 32 that bridges across the outer feed port 17. The generator effective internal impedance 33 is shown in series between one side of the generator 31 and the end of element 13 located at the outer feed port 17.

In operation at the low frequency band, generators 23 and 31 are set to zero output. The outer bandpass filters 24, 32 are set to a very low or substantially zero impedance so that effectively a short circuit appears across the outer feed ports 15, 17. The first and second filters 27, 28 are set to match the impedance of the low band dipole (which appears to be resonant for the low-frequency band) to the impedance 30 of the generator 26. For high frequency band operation, generator 26 is set for zero output. The first and second filters 27, 28 are set to produce a very high impedance or substantially an open circuit between elements 12 and 13 at the center feed port 16. Generators 23 and 31 provide excitation at the outer feed ports 15, 17 and now drive the high frequency band dipole array which is resonant in the high frequency band. Filters 24 and 32 are set to match the generators 23 and 31 to the impedance of the high frequency array.

Figure 3:
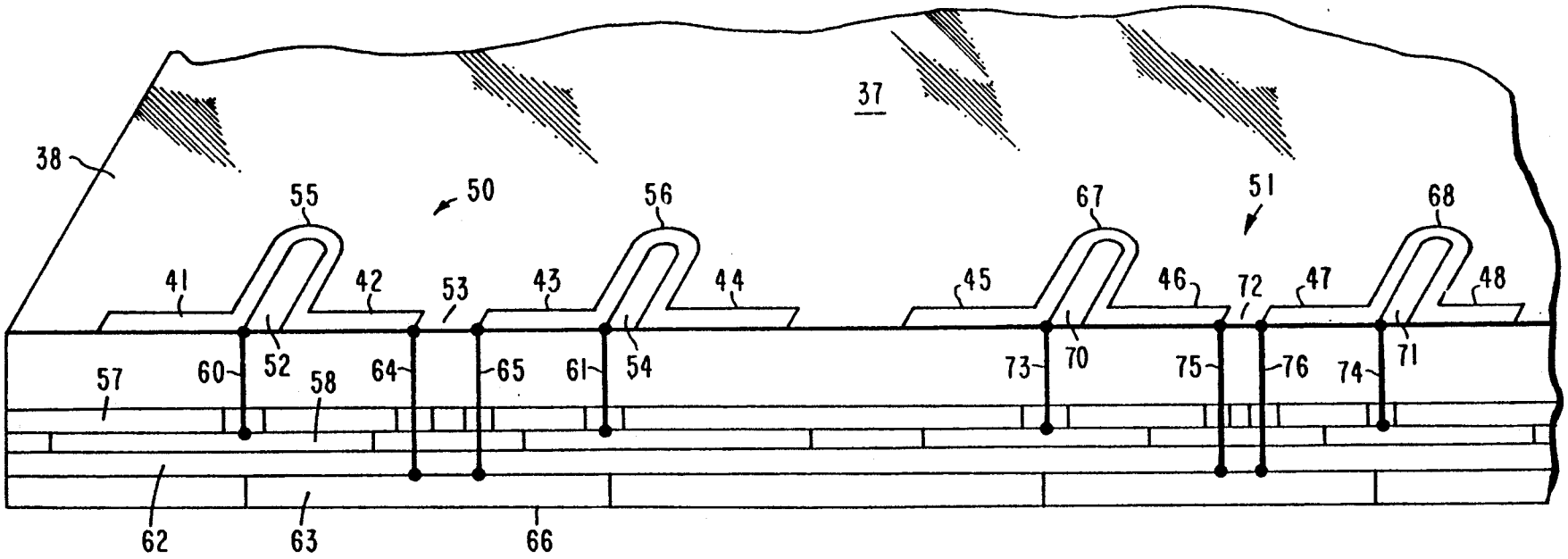
FIG. 3 is perspective view of a dual band dipole array antenna of the present invention incorporated into a microwave monolithic integrated circuit (MMIC) structure.

Referring now to FIG. 3 of the drawings, there is shown an embodiment of a multi-frequency band phased array antenna 36 in accordance with the invention incorporated into a MMIC (microwave monolithic integrated circuit) structure 37. This configuration of a dual band printed MMIC phased array antenna 36 has a high-K dielectric substrate 38 on which are printed a plurality of dipole elements 41–48. Four of these elements 41–44 form an array 50 that corresponds to the embodiment of the phased array antenna 10 shown in FIG. 2, and the other four elements 45–48 represent a second such array 51.

Referring now to the first array 50, there are three feed ports 52, 53, 54. A first printed stub 55 is bridged across the first feed port 52, and a second stub 56 is bridged across the third feed port 54. The length L of the entire printed stubs 55, 56 is one wavelength at the low frequency band and one-and-one-half wavelengths at the high frequency band. At the low frequency band the terminals of the stubs 55, 56 appear to be short circuited. At the high frequency band the terminals of the stubs 55, 56 provide a 180 degree phase difference for a balun. Below the substrate 38 there is provided an antenna ground plane 57. Below the ground plane 57 there is provided an MMIC circuit layer 58 at the high frequency band.

The MMIC circuit layer 58 is printed on monolithic substrate material behind the antenna ground plane 57 and includes circuits such as high power amplifiers, low noise amplifiers, and phase shifters, etc. A first feed probe 60 extends from the MMIC circuit layer 58 to the end of element 41 that is connected to the first stub 55. A second feed probe 61 extends from the MMIC circuit layer 58 to the end of element 43 that is connected to the second stub 56. Below the high frequency band MMIC layer 58 there is a layer of dielectric 62. Below the dielectric 62 there is a second MMIC circuit layer 63 printed on a monolithic substrate material. This second MMIC circuit layer 63 also includes circuits such as high power amplifiers, low noise amplifiers, phase shifters, and etc, plus the necessary bandpass filters corresponding to filters 27, 28 of FIG. 2. Two feed probes 64, 65 are provided to interconnect the second MMIC circuit layer 63 with the first array 50. The first feed probe 64 interconnects the MMIC circuit layer 63 to the end of element 42 located at feed port 53. The second feed probe 65 connects the MMIC circuit layer 63 to the end of element 43 which is located at the feed port 53. Another ground plane 66 is provided below the low frequency MMIC circuit layer 63.

In operation, the two MMIC circuit layers 58, 63 comprise MMIC integrated circuits utilized to drive the dipole elements 41–44, for example, in transmit mode and process incoming signals in receive mode. The low frequency band MMIC circuit layer 63 provides a signal at the low frequency band which is fed to the array 50 by means of the low frequency feed probes 64, 65. The terminals of the stubs 55, 56 across the feed ports 52, 54 appear to be short circuited so that the elements 41 and 42 combine to form one arm of a low frequency band dipole; elements 43, and 44 combine to form the other arm of the low frequency band dipole. When operating at the high frequency band, the high frequency MMIC circuit layer 58 generates a signal which is applied by the high frequency feed probes 60, 61 to elements 41, 43 of the array 50. The stubs 55, 56 act as baluns and give a 180 degree phase difference to drive the other elements 42, 44 of the array 50. An open circuit appears at the middle port 53.

In a similar manner, the other printed array 51 is also provided with two stubs 67, 68. The first stub 67 is bridged between element 45 and element 46 at a first feed port 70 and the second stub 68 is bridged between element 47 and element 48 at a second feed port 71. A middle feed port 72 is provided between the end of element 46 adjacent to the end of element 47. A high frequency band feed probe 73 connects the high frequency MMIC circuit layer 58 to the end of element 45 connected to the first stub 67. Another feed probe 74 connects the high frequency band MMIC circuit layer 58 to the end of element 47 that is connected to the second stub 68. A low frequency band feed probe 75 connects the low frequency MMIC circuit layer 63 to the end of element 46 adjacent the middle feed port 72. Another low frequency band feed probe 76 connects the low frequency MMIC circuit layer 63 to the end of element 47 adjacent the middle feed port 72. The second array 51 operates in a similar fashion to the first array 50 and the two arrays cooperate to provide an enhanced beam at the high and low frequency bands. The active dipole elements all lie in the same plane, and clearly the number of arrays employed may be increased to any number desired.

The printed stubs 55, 56, 67, 68 on the phased array antenna 36 have two-fold functions: at the low frequency band the stub terminals become short circuited so that the entire dipole becomes an arm of the low frequency dipole. At the high frequency band, the stubs 55, 56, 67, 68 work as the balun circuits to provide the 180 degree phase difference for the two arms of the dipole. Appropriate low pass filters within the MMIC structure 37 (not visible in FIG. 3) become open circuited at the high frequency band, and the array 36 is matched to the generator impedance at the low frequency band.

Figure 4:
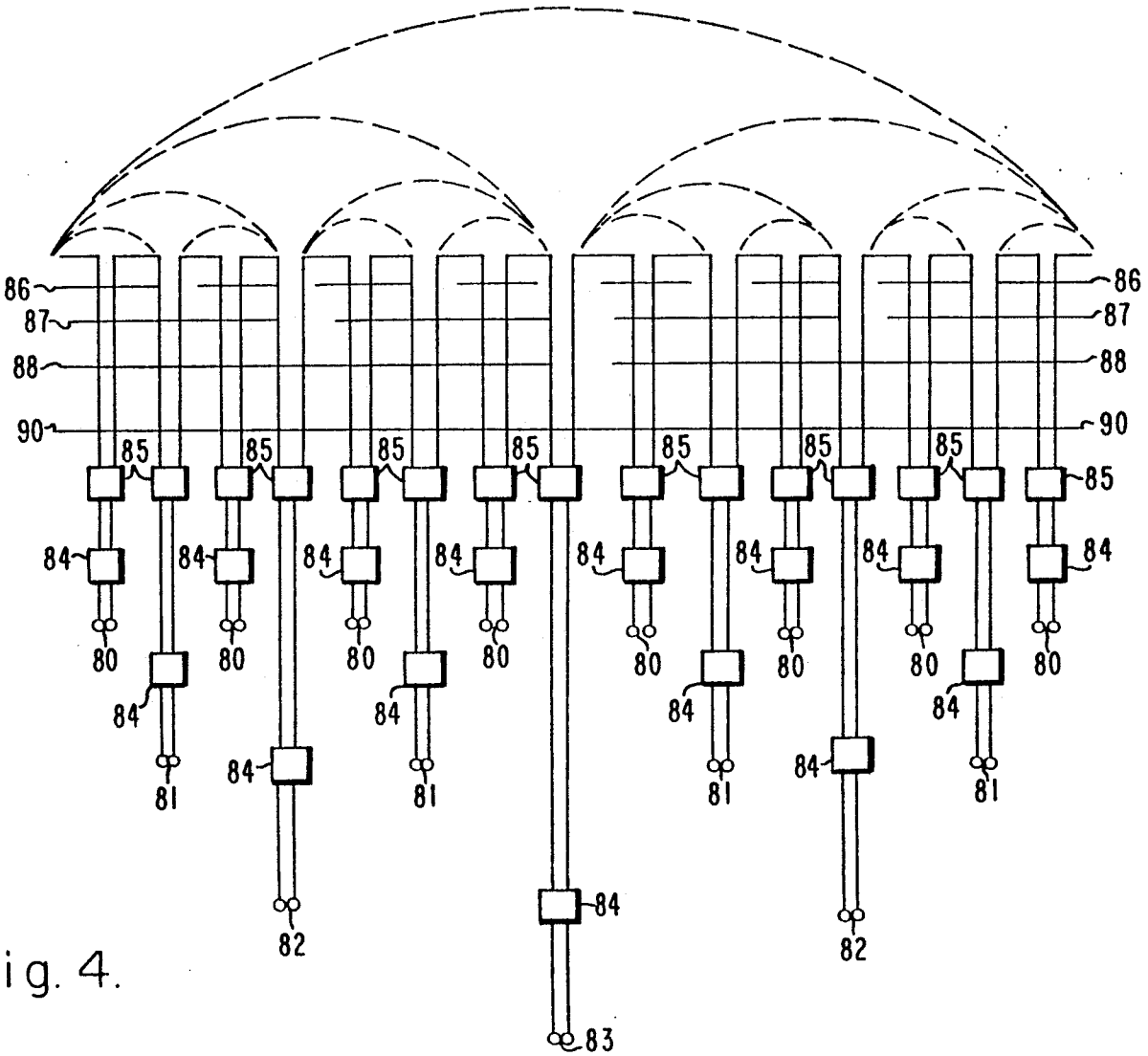
FIG. 4 is a schematic diagram of another embodiment of the multi-frequency band phased array antenna of the present invention illustrating coplanar dipoles with multiple feed ports covering four frequency bands.

Referring now to FIG. 4 of the drawings, an extension of the two band operation to four band operation is shown. Separated feed networks for each band are used. There are 8 high-band feeds 80, four high-intermediate band feeds 81, two low-intermediate band feeds 82, and one low-band feed 83. With independent feeds 80–83 the antenna is capable of forming simultaneously and independently steerable beams. Each band has separated feeds 80–83 and phase shifters 84 but shares a common aperture. Each feed 80–83 is provided with its own separate bandpass filter 85 (short or open).

Due to the change in the effective dipole height as a function of frequency, several frequency selective ground planes are used for different operating frequency bands. High frequency ground screens 86 are arranged to be closer to the active radiating elements than the lower frequency ground planes 87, 88, 90 and results in good ground reflection at the resonant frequency. For lower frequency operation, the combined effect of the high frequency screen 86 and the additional low frequency screens or ground planes 87, 88, 90 will give desirable ground reflection for the particular operating frequency.

Thus there has been described a new and improved aperture design for a multi-frequency array antenna utilizing coplanar dipoles with multiple feed ports. In this antenna, active dipole elements all lie on the same plane. The objective of the invention is to achieve a different effective dipole length for each operating frequency band. In order to do so, each element is connected to multiple excitation ports together with a set of band pass filters. The band pass filters are used to achieve open circuits or short circuits for a particular operating frequency band. The purpose is to provide radiating elements and arrays for multiple frequency phased arrays that span over several frequency bands. Such arrays may be used simultaneously for surveillance radar, communications and ESM applications. This antenna has the advantage of compact radiating aperture design with no blockage between radiating elements. Good isolation between each frequency band is achieved by using the band pass filters. The feed network packaging can be simple and compact. The dipoles and their associated feed network and phase controls can be printed in the same circuit board. They can also be arranged in a feed through lens array arrangement to simplify the feed circuit.

It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A two-dimensional multiple feed multiple layer dipole array employing printed circuit techniques, said dipole array comprising:

a plurality of dielectric boards protruding from a ground plane;

a plurality of sets of printed dipole elements disposed along the edge of each board, each of the sets of dipole elements having two outer feed ports and a center feed port; and a plurality of bandpass filters, one of the bandpass filters being coupled to each of the feed ports, the impedance of the filters at the outer feed ports being substantially a short circuit at a predetermined low frequency band, the impedance of the center feed port being substantially an open circuit at a predetermined high frequency band;

whereby at the predetermined low frequency band the outer feed ports are substantially shorted by the filters so that the two sections of dipole elements to the left of the center feed port form one low band dipole arm, and the two sections of dipole elements to the right of the center feed port form the other low band dipole arm; and whereby at the predetermined high frequency band, the center feed port becomes substantially an open circuit so that the two dipole sections to the left thereof form one high band dipole, and the two sections to the right thereof form a second high band dipole.

2. A multi-frequency band phased-array antenna using coplanar dipole arrays with multiple feed ports to achieve a different effective dipole length for each operating frequency band comprising:

first and second dipole antennas disposed in a coplanar relationship to define a common antenna aperture;

first, second and third excitation generators adapted for selective coupling to said first and second dipole antennas for high band and low band operation; and first, second and third bandpass filters selectively coupling said first and second dipole antennas and said first, second and third excitation generators for high band and low band operation;

said second excitation generator being adapted to selectively apply a low band excitation signal through said second bandpass filter to adjacent ends of said first and second dipole antennas at the same time that said first and third excitation generators have an output of zero and said first and third bandpass filters bridge the excitation terminals of said first and second dipole antennas with zero impedance;

said first and third excitation generators being adapted to selectively apply a high band excitation signal to the excitation terminals of said first and second dipole antennas at the same time that said second excitation generator has an output of zero and said second bandpass filter presents an open circuit impedance between adjacent ends of said first and second dipole antennas.

3. A coplanar dipole array antenna arrangement adapted to selectively operate as a high band antenna and as a low band antenna comprising:

first and second dipole antennas having first and second feed ports, said dipole antennas being arranged in a coplanar relationship with two adjacent ends, said adjacent ends defining a third feed port at a low band frequency;

first, second, third and fourth bandpass filters that develop either an open circuit impedance or a short circuit impedance at high band frequencies and low band frequencies;

said first and fourth filters being coupled to said first and second feed ports and arranged to develop a short circuit impedance at low band frequencies and an open circuit impedance at high band frequencies;

said second and third filters being coupled in series with said adjacent end defining a third port and arranged to develop an open circuit impedance at high band frequencies;

a source of low band excitation signals coupled in series through said second and third filters to said third feed port; and first and second sources of high band excitation signals coupled to said first and second feed ports in parallel with said first and fourth filters.

4. A dual band dipole array antenna comprising microwave monolithic integrated circuit structures, said dipole array antenna comprising:

a high-K dielectric substrate;

a plurality of sets of printed dipole elements disposed along the edge of the substrate, each of the sets of dipole elements having two outer fed ports and a center feed port;

a plurality of U-shaped printed stubs across each of the outer feed ports, the length of the stubs being one wavelength at a predetermined low frequency band and being one and one-half wavelength at a predetermined high frequency band;

a first integrated circuit layer dielectrically separated from the substrate and having a plurality of low band microwave monolithic integrated circuits disposed therein that are coupled to respective ones of the outer feed ports; and a second integrated circuit layer dielectrically separated from the first integrated circuit layer and having a high band microwave monolithic integrated circuit disposed therein that is coupled to the center feed port;

whereby at the predetermined low frequency band, the terminals of the stubs appear to be substantially short circuited, and whereby at the predetermined high frequency band, the stubs comprise baluns and provide a 180 degree phase difference at the terminals thereof.

5. A multi-frequency band phased array antenna having multiple feed ports in a single aperture and characterized by:

a plurality of coplanar dipole elements having substantially the same length;

a plurality of bandpass filters individually coupled between adjacent ones of the dipole elements; and a plurality of phase shifters individually coupled to respective ones of the plurality of bandpass filters;

wherein the ends of the plurality of dipole elements define a respective plurality of feed ports between adjacent dipole elements, and wherein selected ones of the feed ports are adapted to be energized at one operating frequency band and different, unique ones of the feed ports are adapted to be energized at another operating frequency band; and a dielectric substrate protruding from a ground plane and having the dipole elements disposed along the edge of the board, the dipole elements comprising two outer feed ports and a center feed port, and having one of the plurality of bandpass filters coupled to each of the feed ports, the impedance of the filters at the outer feed ports substantially comprising a short circuit at a predetermined low frequency band, the impedance of the center feed port substantially comprising an open circuit at a predetermined high frequency band;

whereby at the predetermined low frequency band the outer feed ports are substantially shorted by the filters so that the two dipole elements to the left of the center feed port form one low band dipole arm, and the two dipole elements to the right of the center feed port form the other low band dipole arm; and whereby at the predetermined high frequency band, the center feed port substantially comprises an open circuit so that the two dipole elements to the left thereof form one high band dipole element, and the two dipole elements to the right thereof form a second high band dipole element.

* * * * *